United States Patent [19]

Bohan, Jr.

[11] Patent Number: 4,696,639

[45] Date of Patent: Sep. 29, 1987

[54] SELF-ENERGIZING BURNER CONTROL SYSTEM FOR A FUEL BURNER

[75] Inventor: John E. Bohan, Jr., Minneapolis, Minn.

[73] Assignee: Honeywell Inc., Minneapolis, Minn.

[21] Appl. No.: 927,485

[22] Filed: Nov. 6, 1986

[51] Int. Cl.[4] ..... F23Q 9/08

[52] U.S. Cl. ..... 431/59; 431/42; 431/80; 137/66; 331/66

[58] Field of Search ..... 43/42, 59, 80; 137/66; 331/65, 66

[56] References Cited

U.S. PATENT DOCUMENTS

| | | | |
|---|---|---|---|
| 2,268,960 | 1/1942 | Ray | 137/139 |
| 2,610,677 | 9/1952 | Lange | 431/24 |
| 3,157,222 | 11/1964 | Hassa | 137/66 |
| 3,439,991 | 4/1969 | Fathauer | 431/71 |
| 3,474,963 | 10/1969 | Buiting et al. | 236/68 |
| 3,545,676 | 12/1970 | Barker | 236/75 |
| 3,711,236 | 1/1973 | Kinsella et al. | 431/53 |
| 3,779,459 | 12/1973 | Battersby et al. | 236/15 A |
| 3,853,455 | 12/1974 | Riordan et al. | 431/80 |
| 4,019,854 | 4/1977 | Carlson et al. | 431/80 |
| 4,435,150 | 3/1984 | Rippelmeyer | 431/42 K |
| 4,459,097 | 7/1984 | Riordan et al. | 431/25 |

OTHER PUBLICATIONS

General Controls Catalog No. 51—p. 8 "All-Gas B-60 Series Controls".

Linear Technology Catalog sheet LTC1041 from item with 1985 copyright.

*Primary Examiner*—Margaret A. Focarino

*Attorney, Agent, or Firm*—Alfred N. Feldman

[57] ABSTRACT

A self-energizing burner control system for a fuel burner is accomplished by heat from a standing pilot energizing a thermoelectric generator. The thermoelectric generator supplies power to an oscillator. The oscillator has an output that is stepped up in voltage level and converted to a regulated direct current potential. The regulated direct current potential in turn is then used to operate a solid state temperature control or controller. The controller in turn responds to a temperature at a thermistor to control a field effect transistor and series connected solenoid of a fuel valve.

9 Claims, 1 Drawing Figure

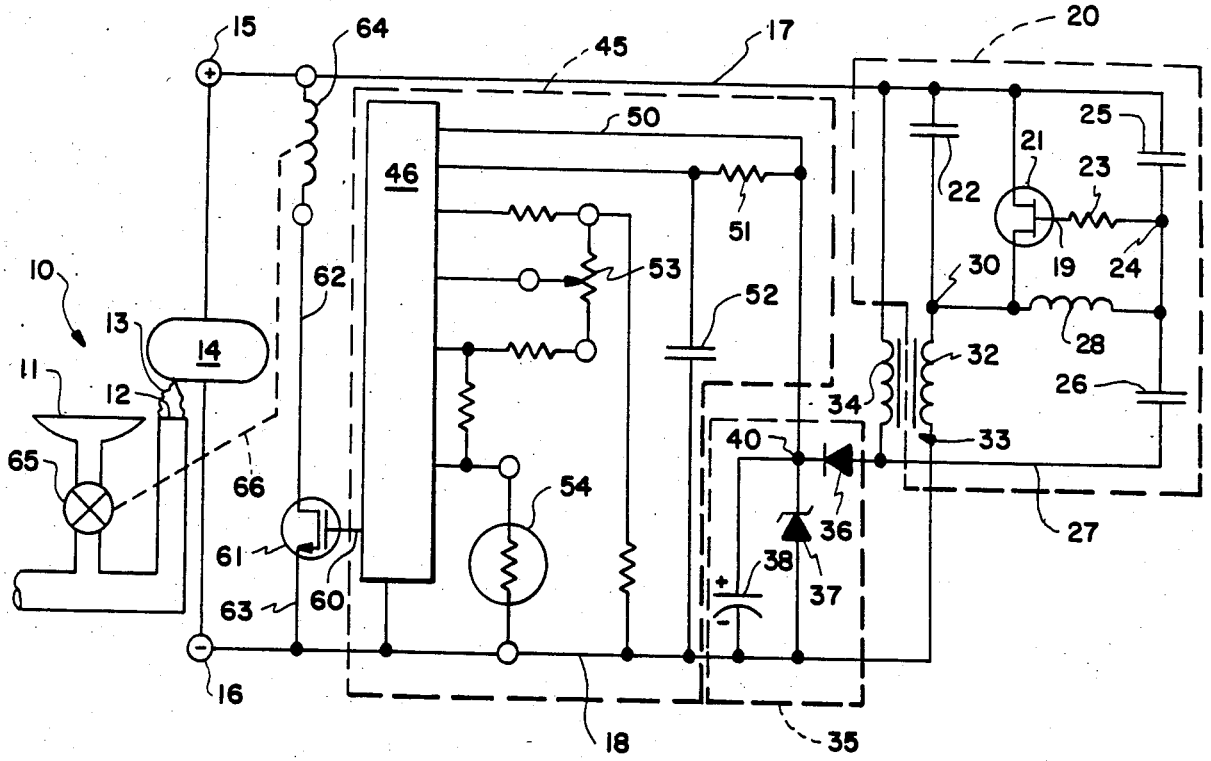
15
64
45
17
20
50
46
25
21
23
22
51
53
19
24
10
62
30
52
13
14
28
32
11
12
26
34
40
33
65
66
54
36
27
61
38
37
63
60
16
18
35

SELF-ENERGIZING BURNER CONTROL SYSTEM FOR A FUEL BURNER

BACKGROUND OF THE INVENTION

Self-energizing burner control systems of an electromechanical nature have been available for a number of years. The self-energizing systems typically use a thermoelectric generator that is made up of a group of thermocouples connected in series. These types of units have been marketed in the past, and Honeywell Inc. markets such a unit under the tradename Powerpile. The thermoelectric generator means or Powerpile is exposed to a pilot flame at a burner and generates a very low potential direct current. This very low power direct current voltage is applied to a special type of fuel valve, and is controlled by a mechanical thermostat so that the valve can be opened and closed in response to the thermostat. These types of systems have limited applications because of the frailities of the thermostat which must switch exceedingly low levels of direct current potential and current.

SUMMARY OF THE INVENTION

The present invention is directed to a self-energizing burner control system in which a thermoelectric generator means or Powerpile is exposed to a pilot burner and generates a very low level of direct current potential. This very low level of direct current potential is used to drive an oscillator means, specifically disclosed as a modified Colpitts oscillator means. The oscillator means provides an alternating current output which is stepped up by a transformer. The output of the transformer, being higher in voltage than would ordinarily be available from a Powerpile, can be used with a rectifier and capacitor type of system to provide a direct current voltage of approximately five volts. This potential is then used to energize a very low power, solid state temperature control means.

The temperature control means includes a monolithic CMOS controller that is capable of being energized from approximately five volts direct current, and utilizes a very low amount of energy for its operation. The controller in turn operates a solid state switch that is in series with a valve of a type used with a thermoelectric generator system.

With the present arrangement, a complete solid state operated self-energized burner control system is possible. This system avoids the frailities of the electromechanical system in that there is no mechanical contact to open and close at the exceedingly low voltage and current levels provided by the thermoelectric generator.

In accordance with the present invention, there is provided a self-energizing burner control system for burner means having a pilot burner and a main burner, including: thermoelectric generator means responsive to a flame from said pilot burner to generate a direct current potential; fuel valve means for controlling fuel to said main burner; solid state switch means and said fuel valve means connected in series to said direct current potential wherein the operation of said solid state switch means controls said direct current potential to in turn control said valve means; oscillator means including connection means connecting said oscillator means to said direct current potential to energize said oscillator means to produce an alternating current output voltage; voltage step-up means having an input responsive to said oscillator means output voltage, and an output connected to rectifier and capacitor means to provide a direct current power supply; solid state temperature control means energized from said direct current power supply means; said solid state temperature control means including a temperature sensor responsive to a temperature to be controlled; and said temperature control means having an output connected to said solid state switch means; said solid state temperature control means controlling said solid state switch means to operate said valve means.

BRIEF DESCRIPTION OF THE DRAWING

The single FIGURE discloses a self-energizing burner control system.

DESCRIPTION OF THE PREFERRED EMBODIMENT

The self-energized burner control system of the present invention includes a burner means generally disclosed at 10 which includes a main burner 11 and a pilot burner 12. A flame 13 is shown from the pilot burner 12. This would be comparable to a conventional standing pilot configuration.

The flame 13 impinges on a thermoelectric generator means 14 that would normally be a thermocouple stack or Powerpile as sold by Honeywell. The thermoelectric generator means 14 has a direct current output as shown at terminals 15 and 16. This output voltage typically is approximately 750 millivolts (0.75 volts). It is quite obvious that this low of voltage requires special equipment to utilize it in a system.

The voltage from the terminals 15 and 16 is connected by a pair of conductors 17 and 18 to the balance of the system. The conductor 17 is connected to an oscillator means generally disclosed at 20. This particular oscillator means is a modified Colpitts oscillator and its operation will be described in some limited detail later in the present disclosure. The structural components of the oscillator means 20 include a field effect transistor 21 having a gate 19 and has its source-drain connected across a capacitor 22. The gate 19 of the field effect transistor 21 is connected through a resistor 23 to a node 24. The node 24 separates two capacitors 25 and 26. The capacitor 25 is connected between the positive potential conductor 17 and the node 24. The second capacitor 26 is connected between the node 24 and a conductor 27 for the oscillator means 20. Further contained within the oscillator means 20 is an inductor 28 that is connected between the node 24 and source-drain of the field effect transistor 21 at a node 30.

The oscillator means 20 will be described in operation during the description of operation of the overall circuit. It is enough to understand at this point that the oscillator means 20 will go into oscillation, and will supply an alternating current to a primary winding 32 of a voltage step-up means shown as a transformer 33. This transformer 33 has a secondary winding 34 as an output.

The operation of the oscillator means 20 provides an alternating current potential to the primary winding 32 which is stepped up and appears as a higher alternating current potential at the secondary 34. The voltage on the secondary winding 34 is connected between the conductor 27 and the conductor 17. The alternating current voltage available is in turn provided to a direct current power supply 35 that includes a rectifier 36, a zener diode 37, and a storage capacitor 38. The operation of the direct current power supply is quite well known and the alternating current from the secondary 34 is rectified by the diode 36, clipped by the zener diode 37, and stored as a regulated voltage by the capacitor 38. As such, a node 40 becomes a regulated direct current power supply for the balance of the system. The node 40 has a direct current regulated voltage of slightly over five volts in the present system.

To complete the system, a solid state temperature control means 45 is disclosed. The solid state temperature control system 45 includes an integrated circuit 46 that is a monolithic CMOS controller that utilzies an exceedingly limited amount of power in its operation. The particular monolithic CMOS controller disclosed could be of a type manufactured by Linear Technology and identified as their "Bang-Bang Controller LTC 1041". This particular controller has been disclosed by way of example only, and any very low power controller could be used.

The integrated circuit 46 is powered from the node 40 by energy provided on conductor 50. The solid state temperature controller 45 has its control function established by a group of resistors and a capacitor. A resistor 51 and a capacitor 52 are used to establish a basic operating mode for the device. A variable resistor 53 is used to set a control point at which the solid state temperature control means 45 will operate. This is also a function of a thermistor 54 that becomes the temperature sensor for the system. Based on the value of resistance of the thermistor 54, the value of the other resistors, and the setting of the variable resistance 53, the solid state temperature control means 45 will have a controlled output at the conductor 60. The output on conductor 60 switches in response to the temperature at the thermistor 54 and this in turn controls a field effect transistor 61 or solid state switch means. The solid state switch means 61 is connected by conductors 62 and 63 in a series circuit with a solenoid 64 of a fuel valve means 65. A coupling between the solenoid 64 and valve 65 is shown at 66. The valve 65 and its solenoid 64 are capable of being operated at the exceedingly low potential of 750 millivolts when the field effect transistor 61 is conductive.

OPERATION

The operation of the self-energizing burner control system will be briefly described as most of it is self-evident. The flame 13 at the pilot burner 12 provides heat to the thermoelectric generator means 14 which in turn provides the low potential direct current at the terminals 15 and 16. This potential is supplied to the series connection of the solenoid coil 64 and the field effect transistor 61. Upon the field effect transistor 61 being driven into conduction, the solenoid 64 is energized and the valve 65 opens. The opening of the valve 65 introduces fuel to the main burner 11 and allows the fuel burner means 10 to provide heat to a load, such as a boiler for heating water for a swimming pool. Since the present system is totally self-energized, no auxiliary power is needed or run to the unit and the unit is therefore completely safe in the swimming pool environment.

The direct current potential on conductors 15 and 16 is supplied to the oscillator means 20. A small amount of electrical noise exists in this type of a system and appears on the gate 19 of the field effect transistor 21. This noise is further amplified by the transformer 33. Negative feedback, phase shifted 180 degrees is provided by the inductor 28 and the capacitor 26. The feedback signal is larger than the initial noise. The feedback signal is further amplified by the field effect transistor 21 and the inductor 28 and is again fed back to the gate of the field effect transistor 21. The result is growing oscillations which continue to grow to a maximum level controlled by the input supply voltage on conductors 17 and 18.

The resistor 23 is placed in the circuit to minimize the current flow through the gate 19 to the source and the drain of the field effect transistor 21. Such a current flow could consume power, and hence dampen the oscillations of the oscillator means 20. The capacitors 22, 25, and 26 along with the inductor 28 control the oscillation frequency in the oscillator means 20. As was previously indicated, this is a modified Colpitts oscillator.

The oscillations drive current through the primary winding 32 of the transformer 33 where it is stepped up and provided at a higher voltage level at the secondary winding 34. The power supply means 35 rectifies and stores the voltage to provide a regulated direct current potential of pproximately five volts at the node 40. This regulated voltage in turn is used to energize the solid state temperature control means 45 that has been described in some detail previously.

The thermistor 54, in a pool heater arrangement, would be responsive to the water in a boiler or the swimming pool, and would in turn control the operation of the field effect transistor 61. This in turn opens and closes the valve 65 under the control of the solenoid 64 to either cause fuel to issue from the main burner 11 or to be cut off. As such, the temperature of the load, the swimming pool water, is regulated in temperature as set by the adjustable resistor or potentiometer 53 in response to a sensed temperature at the thermistor 54.

The present invention has been disclosed in a very specific form utilizing a specific electronic controller and oscillator means. It is apparent that a number of variations within the concept disclosed could be accomplished and the applicant wishes to be limited in the scope of his invention solely by the scope of the attached claims.

The embodiments of the invention in which an exclusive property or right is claimed are defined as follows:

1. A self-energizing burner control system for burner means having a pilot burner and a main burner, including: thermoelectric generator means responsive to a flame from said pilot burner to generate a direct current potential; fuel valve means for controlling fuel to said main burner; solid state switch means and said fuel valve means connected in series to said direct current potential wherein the operation of said solid state switch means controls said direct current potential to in turn control said valve means; oscillator means including connection means connecting said oscillator means to said direct current potential to energize said oscillator means to produce an alternating current output voltage; voltage step-up means having an input responsive to said oscillator means output voltage, and an output connected to rectifier and capacitor means to provide a direct current power supply; solid state temperature control means energized from said direct current power supply means; said solid state temperature control means including a temperature sensor and said temperature control means having an output connected to said solid state switch means; said solid state temperature control means controlling said solid state switch means to operate said valve means.

2. A burner control system as claimed in claim 1 wherein said thermoelectric generator means is a thermocouple type means.

3. A burner control system as claimed in claim 2 wherein said temperature sensor is a thermistor.

4. A burner control system as claimed in claim 3 wherein said solid state temperature control means includes an adjustable resistor to set said temperature at which said valve means is controlled.

5. A burner control system as claimed in claim 4 wherein said voltage step-up means is a transformer.

6. A burner control system as claimed in claim 5 wherein said solid state switch means is a field effect transistor.

7. A burner control system as claimed in claim 6 wherein said rectifier and capacitor means includes a zener diode to stabilize said direct current power supply voltage.

8. A burner control system as claimed in claim 7 wherein said oscillator means is a modified Colpitts oscillator including a pair of capacitors and a field effect transistor.

9. A burner control system as claimed in claim 8 wherein said solid state temperature control includes a low powered monolithic CMOS controller having an output connected to control said field effect transistor which is in series with said fuel valve.

* * * * *